US008109189B2

(12) United States Patent
Tsai

(10) Patent No.: US 8,109,189 B2
(45) Date of Patent: Feb. 7, 2012

(54) EFFORT-SAVING HAND OPERATED PUNCHING DEVICE

(75) Inventor: Eric Tsai, Tali (TW)

(73) Assignee: Apex Mfg. Co., Ltd., Taichung Hsien (TW)

( * ) Notice: Subject to any disclaimer, the term of this patent is extended or adjusted under 35 U.S.C. 154(b) by 502 days.

(21) Appl. No.: 12/323,569

(22) Filed: Nov. 26, 2008

(65) Prior Publication Data

US 2010/0126325 A1 May 27, 2010

(51) Int. Cl.
*B26F 1/02* (2006.01)

(52) U.S. Cl. ..... 83/618; 83/634; 83/687

(58) Field of Classification Search ..... 83/684, 83/687, 688, 691, 633, 634, 635, 618, 630, 83/582

See application file for complete search history.

(56) References Cited

U.S. PATENT DOCUMENTS

| | | | | |
|---|---|---|---|---|
| 4,166,404 | A * | 9/1979 | Almog | 83/633 |
| 6,032,566 | A | 3/2000 | Evans et al. | 83/618 |
| 2007/0199424 | A1 * | 8/2007 | Marks | 83/618 |
| 2008/0236353 | A1 * | 10/2008 | Kent et al. | 83/618 |
| 2008/0314219 | A1 * | 12/2008 | Liu | 83/618 |
| 2009/0151532 | A1 * | 6/2009 | Liu | 83/618 |
| 2009/0223341 | A1 * | 9/2009 | Huang | 83/588 |

FOREIGN PATENT DOCUMENTS

| | | |
|---|---|---|
| TW | M 308161 | 3/2007 |

OTHER PUBLICATIONS

Taiwanese Utility Model No. TW M288231, Mar. 1, 2006, 6 pages.
Taiwanese Utility Model No. TW M311570, May 11, 2007, 10 pages.
Taiwanese Utility Model No. TW M308161, Mar. 21, 2007, 2 pages, claim only.
Chinese Utility Model No. CN201183279, Jan. 21, 2009, 17 pages.

* cited by examiner

*Primary Examiner* — Stephen Choi
(74) *Attorney, Agent, or Firm* — Alan Kamrath; Kamrath IP Lawfirm, PA

(57) ABSTRACT

A hole punching device includes two first punching members and a second punching member intermediate the two first punching members. First, second and third lever arms are adapted to render one of the two first punching members, another of the two first punching members and the second punching member to press holes in sheets respectively. The first lever arm has a longitudinal length longer than those of the second and third lever arms, with the second lever arm being longer than that of the third lever arm. Further, the first lever arm actuates the second and third lever arms upon depression of the hole punching device.

16 Claims, 15 Drawing Sheets

EFFORT-SAVING HAND OPERATED PUNCHING DEVICE

BACKGROUND OF THE INVENTION

1. Field of the Invention

The present invention relates to a hole punching device and, in particular, to an effort-saving punching device.

2. Description of the Related Art

Typically, an office hole punching device is a tool that is used to create holes in sheets of paper, and it has a long lever which is used to push a bladed cylinder straight through a number of sheets of paper. Generally, the lever does not need to be more than 8 cm long for sufficient force to handle low volume hole punches. However, if handling large volumes, there is then a demand for utilizing a very long lever arm in order that the punching effort can be saved. TW Pat. No. M308161 is a representative of an effort to provide a labor-saving punching device. Nevertheless, there is still a need for a punching device that accomplishes a greater effort-saving effect.

The present invention is, therefore, intended to obviate or at least alleviate the problems encountered in the prior art.

SUMMARY OF THE INVENTION

According to the present invention, a hole punching device includes a base formed with a plurality of punch holes. Two first punching members are provided, and a second punching member is locatable at various positions intermediate the two first punching members. Each of the first and second punching members includes a punch pin for punching a hole in sheets upon depression of the hole punching device. A first lever arm is pivotally moved with respect to a proximal end of the base and is adapted to move the punch pin of one of the two first punching members into one of the plurality of punch holes upon depression of the hole punching device. A second lever arm is pivotally moved with respect to a distal end of the base and is adapted to move the punch pin of another of the two first punching members into another of the plurality of punch holes upon depression of the hole punching device. A third lever arm is pivotally moved with respect to the second punching member and is adapted to move the punch pin of the second punching member into the other of the plurality of punch holes upon depression of the hole punching device. Moreover, the first lever arm has a longitudinal length longer than those of the second and third lever arms, with the second lever arm being longer than that of the third lever arm. Further, the first lever arm actuates the second and third lever arms upon depression of the hole punching device.

In one embodiment, the first lever arm has a pivotal direction opposite to that of the second lever arm, and the third lever arm has a pivotal direction in accordance with that of the second lever arm.

In another embodiment, the first lever arm has a pivotal direction opposite to that of the second lever arm, and the third lever arm has a pivotal direction opposite to that of the second lever arm.

It is an object of the present invention that the hole punching device effectively accomplishes an effort-saving effect.

It is another object of the present invention that the second punching member is locatable at various positions for various punch hole patterns.

It is a further object of the present invention that the punch pins of the associated first and second punching members can move into the corresponding punch holes sequentially so as to further make depression of the hole punching device effort-saving.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

BRIEF DESCRIPTION OF THE DRAWINGS

The present invention will be described with reference to the accompanying drawings which assist in illustrating the pertinent features thereof, in which.

DETAILED DESCRIPTION OF THE PREFERRED EMBODIMENT

Figure 1:
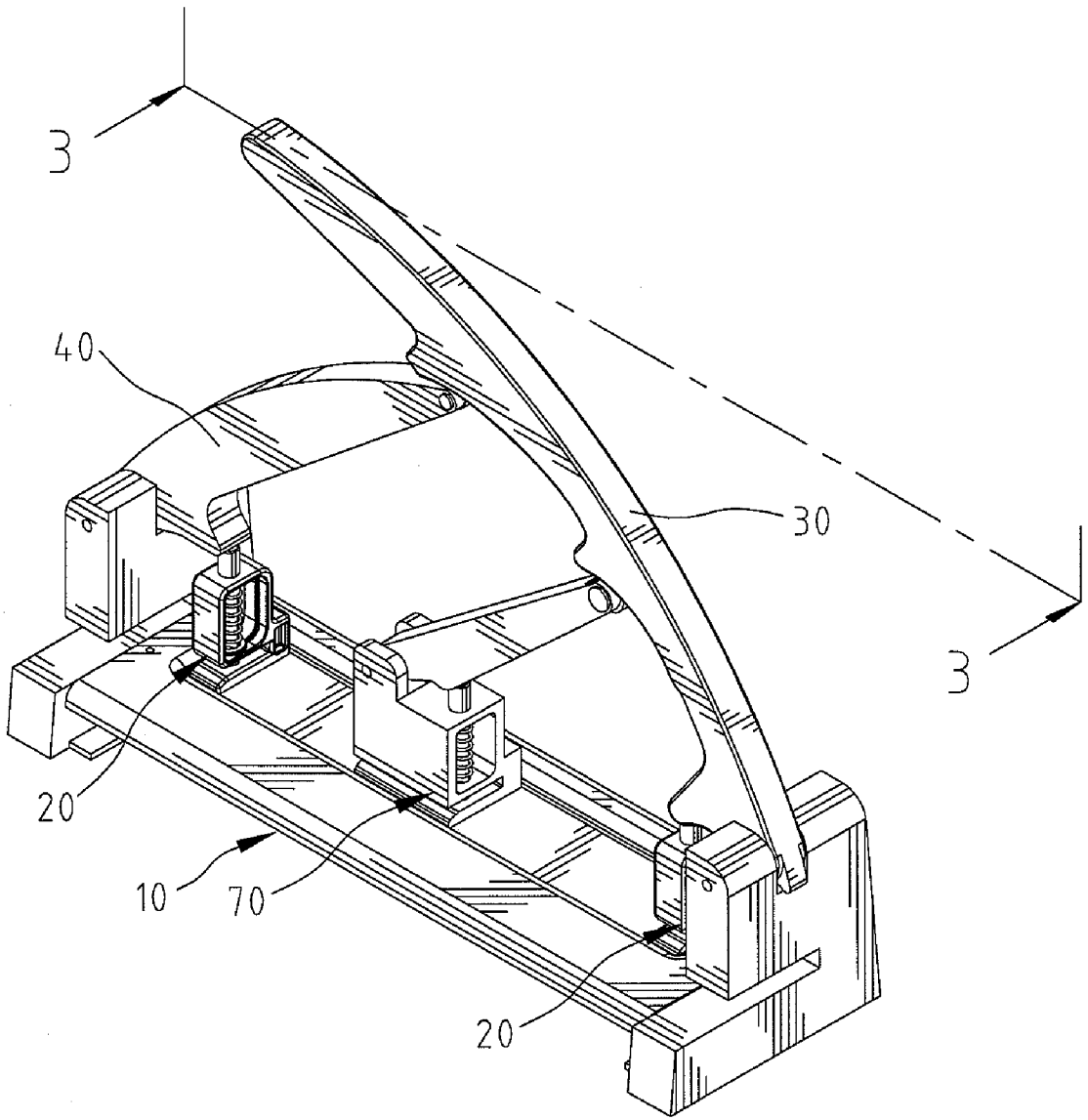
FIG. 1 is a perspective view of a hole punching device in accordance with a first embodiment of the present invention.
Figure 2:
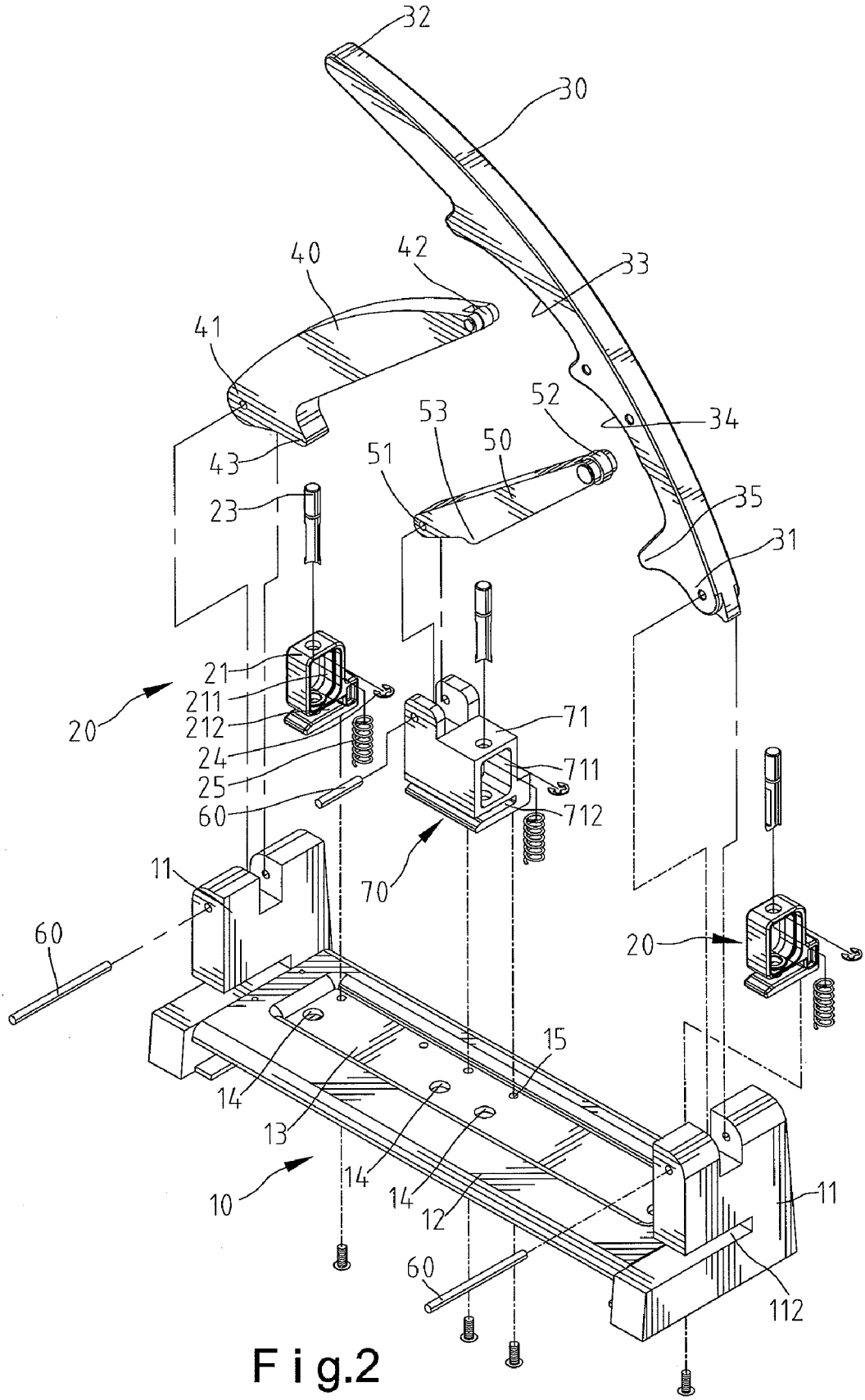
FIG. 2 is an exploded perspective view of FIG. 1.
Figure 3:
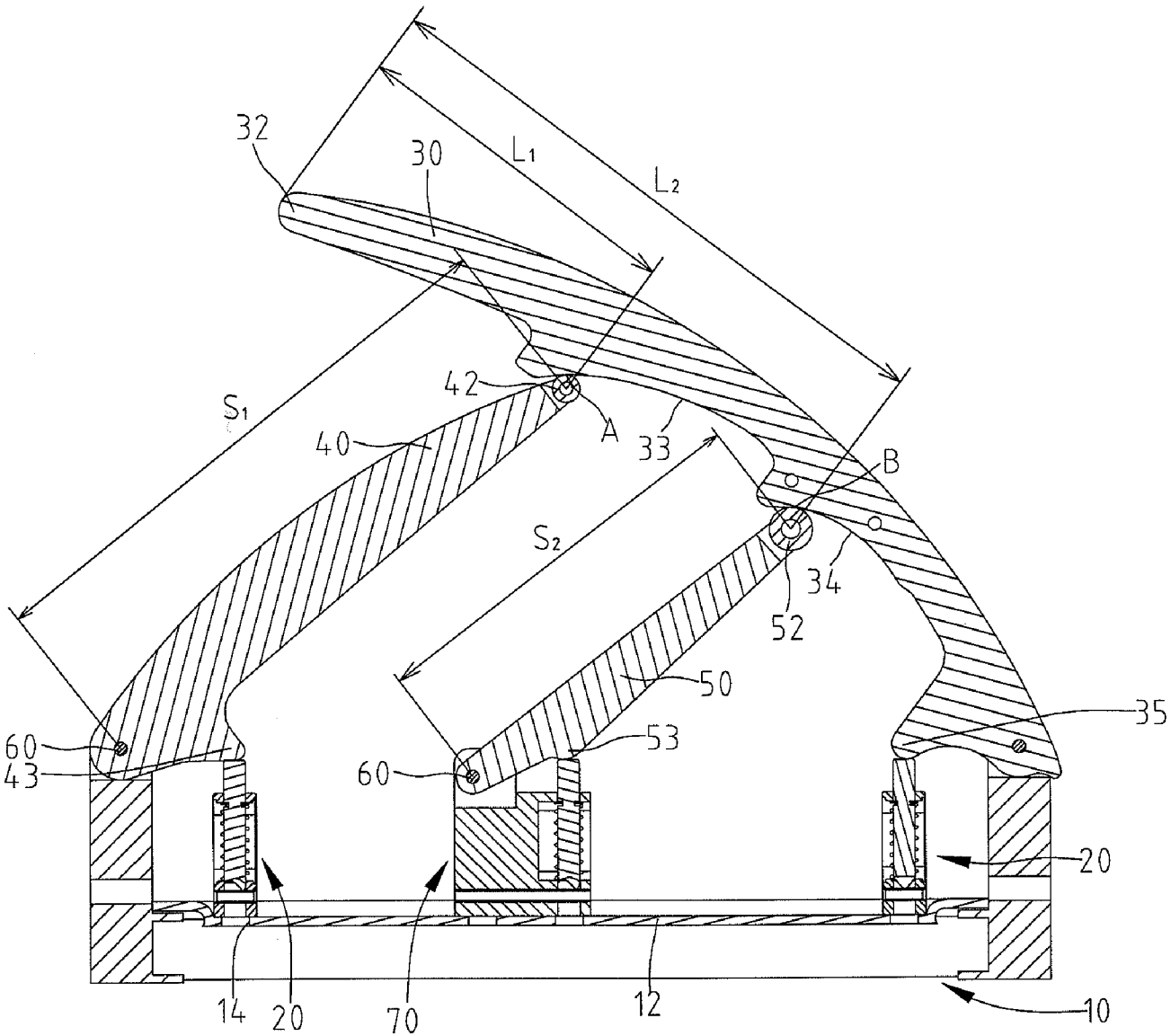
FIG. 3 is a cross-sectional view taken along line 3-3 of FIG. 1.
Figure 4:
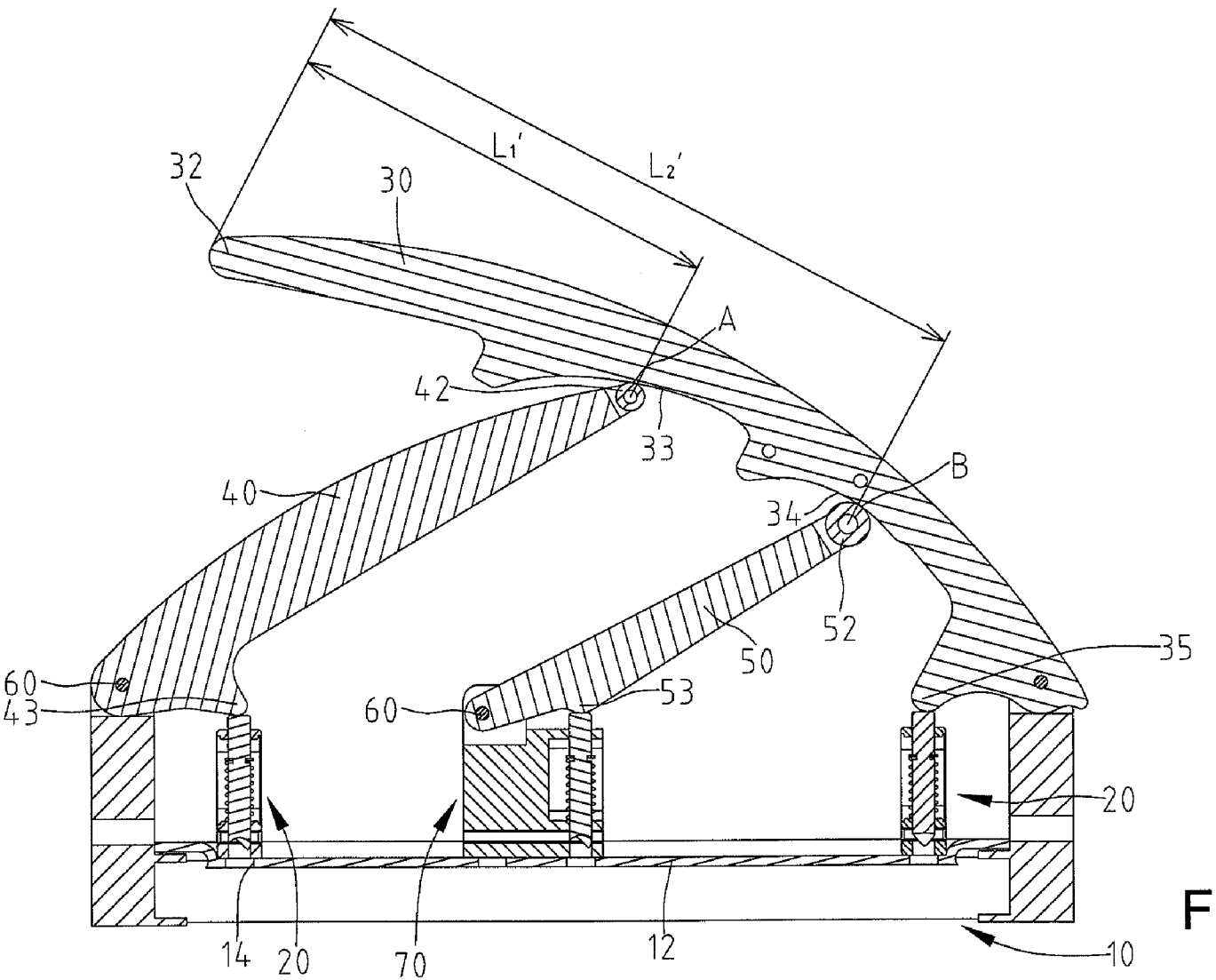
FIG. 4 is another cross-sectional view similar to FIG. 3, illustrating the hole punching device of FIG. 1 in another operational position.

FIGS. 1 though 5 show a hole punching device in accordance with a first embodiment of the present invention. The hole punching device includes a base 10 having two lugs 11 on a proximal end and a distal end thereof respectively.

The base 10 also includes a platform 12 having a receiving area 13 on which two first punching members 20 and a second punching member 70 can mount. Preferably, the two first punching members 20 are mounted on a proximal end and a distal end of the receiving area 13 respectively. Additionally, the second punching member 70 is locatable at various positions intermediate the two first punching members 20. Moreover, each of the first and second punching members 20, 70 are fixed to the platform 12 by fasteners (not numbered). Specifically, the receiving area 13 includes a plurality of holes 15 allowing insertion of the fasteners. Further, a plurality of punch holes 14 are formed on the receiving area 13. In addition, each lug 11 includes a slot 112 adapted to receive and align sheets to be punched on the platform 12.

Each of the first and second punching members 20 and 70 includes a punch pin 23 for punching holes in the sheets upon depression of the hole punching device. Moreover, the pin 23 in each of the first punching members 20 is operably moveable through a compartment 211 and a slotted area 212 of a body 21, and the pin 23 in the second punching member 70 is moveable through a compartment 711 and a slotted area 712 of a body 71. Additionally, the punch pin 23 in each of the first and second punching members 20 and 70 is prevented from disengagement with the associated body 21, 71 by a clip 24. Also, the punch pin 23 in each of the of the first and second punching members 20 and 70 is adapted to be biased in a direction reverse to a direction where the punch pin moves upon depression of the hole punching device by a spring 25.

The hole punching device also includes a first lever arm 30 that is pivotally moved with respect to the proximal end of the base 10 upon depression of the hole punching device. Preferably, the first lever arm 30 includes a pivotal end 31 connected to the lug 11 at the proximal end of the base 10 by a pin 60. Then, the first lever arm 30 is adapted to operably move the punch pin 23 of one of the two first punching members 20 into one of the plurality of punch holes 14. Preferably, the first lever arm 30 includes an engaging portion 35 extending therefrom and abutting the punch pin 23 of the said first punching member 20. Generally, the user depresses the first lever arm 30 at an operational end 32 which is opposite to the pivotal end 31. A second lever arm 40 is pivotally moved with respect to the distal end of the base 10 upon depression of the hole punching device. Preferably, the second lever arm 40 includes a pivotal end 41 connected to the lug 11 at the distal end of the base 10 by another pin 60. Then, the second lever arm 40 is adapted to operably move the punch pin 23 of another of the two first punching members 20 into another of the plurality of punch holes 14. Preferably, the second lever arm 40 includes an engaging portion 43 extending therefrom and abutting the punch pin 23 of the said first punching member 20. Additionally, a third lever arm 50 is pivotally moved with respect to the second punching member 70 upon depression of the hole punching device. Preferably, the third lever arm 50 includes a pivotal end 51 connected to the second punching member 70 by the other pin 60. Then, the third lever arm 50 is adapted to operably move the punch pin 23 of the second punching member 70 into the other of the plurality of punch holes 14. Preferably, the third lever arm 50 includes an engaging portion 53 extending therefrom and abutting the punch pin 23 of the second punching member 70. Preferably, the first, second and third lever arms 30, 40, 50 pivot coplanar in relation to each other. However, it is appreciated that the arms 30, 40, and 50 pivoting in different planes is within the scope of the present invention. Further, the first lever arm 30 has a longitudinal length longer than those of the second and third lever arms 40, 50, with the second lever arm 40 being longer than that of the third lever arm 50. Further, the first lever arm 30 actuates the second and third lever arms 40, 50 upon depression of the hole punching device.

In use, the first lever arm 30 has a pivotal direction opposite to that of the second lever arm 40, and the third lever arm 50 has a pivotal direction in accordance with that of the second lever arm 40. The second lever arm 40 includes a sliding end A moveable on and between the pivotal end 31 and the operational end 32 of the first lever arm 30. The third lever arm 50 includes a sliding portion B moveable on and between the pivotal end and operational end of the first lever arm 30. Preferably, the first lever arm 30 includes a first guiding groove 33 and a second guiding groove 34 where the sliding end A of the second lever arm 40 and the sliding portion B of the third arm 50 are moveably received respectively. Preferably, each of the second and third lever arms 40, 50 includes a roller 42, 52 installed to the sliding end A and the sliding portion B thereof respectively such that more effort can be saved during operation thereof.

Note that the hole punching device has a length measured from the operational end 32 to the sliding end A as L1, and L1 will increase to L' and L1'" as the hole punching device is further depressed. Further, the hole punching device has a length measured from the operational end 32 to the sliding portion B as L2, and L2 will increase to L2' and L2" as the hole punching device is further depressed. Additionally, the second lever arm 40 defines a load arm distance S1, and the third lever arm defines a load arm distance S2 smaller than S1. As a result, these phenomenons allow an effort-saving operation.

Figure 5:
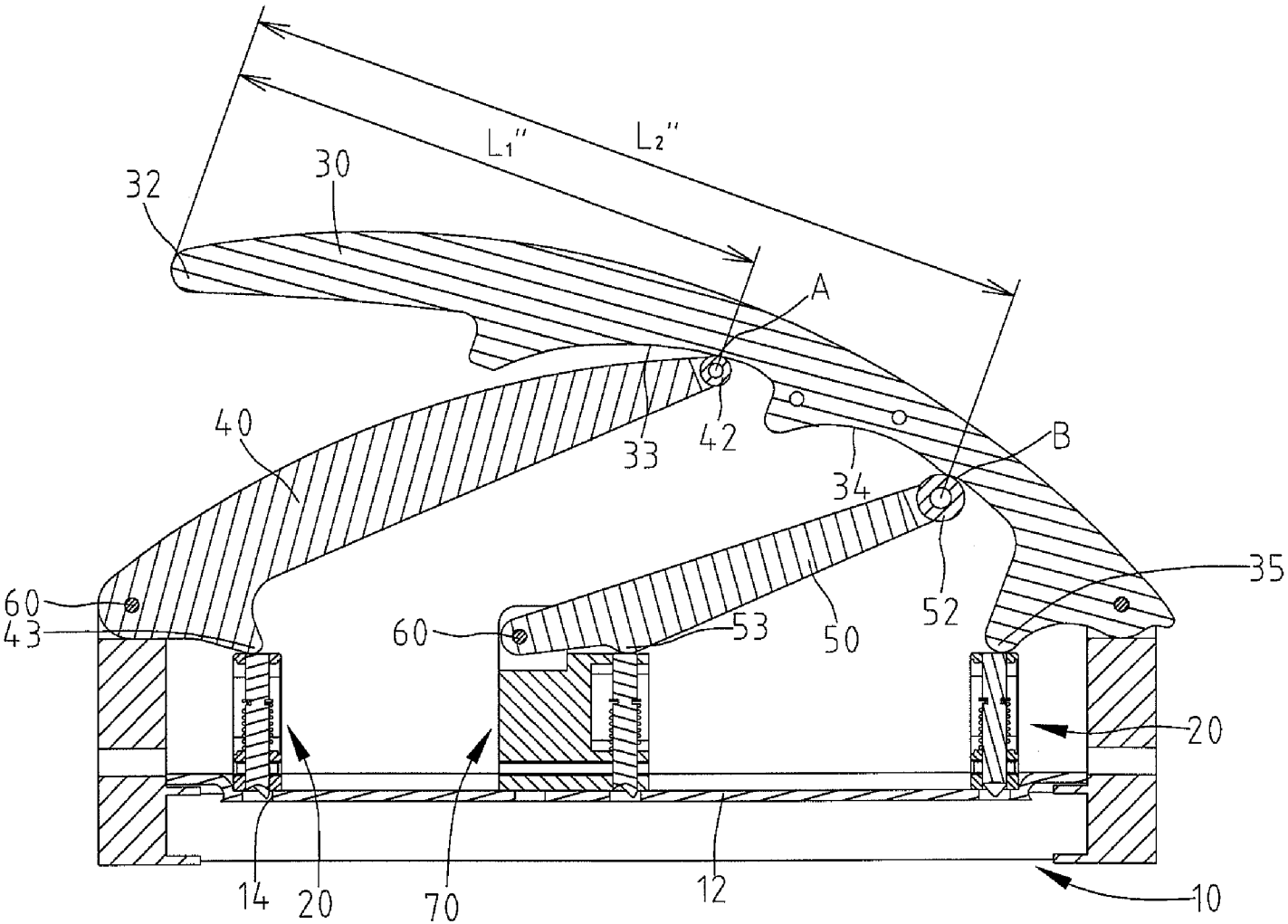
FIG. 5 is another cross-sectional view similar to FIG. 3, illustrating the hole punching device of FIG. 1 in another operational position.
Figure 6:
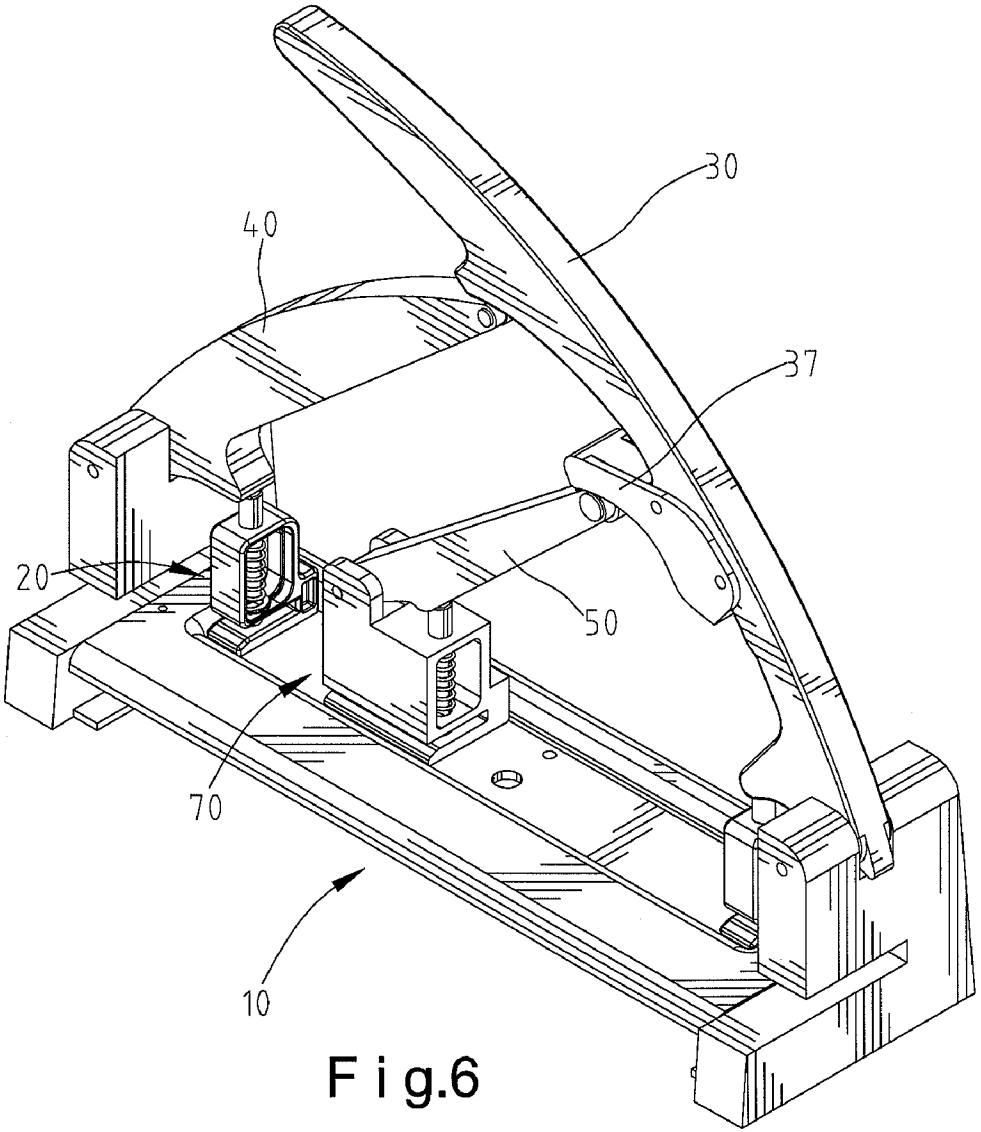
FIG. 6 is a perspective view of a hole punching device in accordance with a second embodiment of the present invention.
Figure 7:
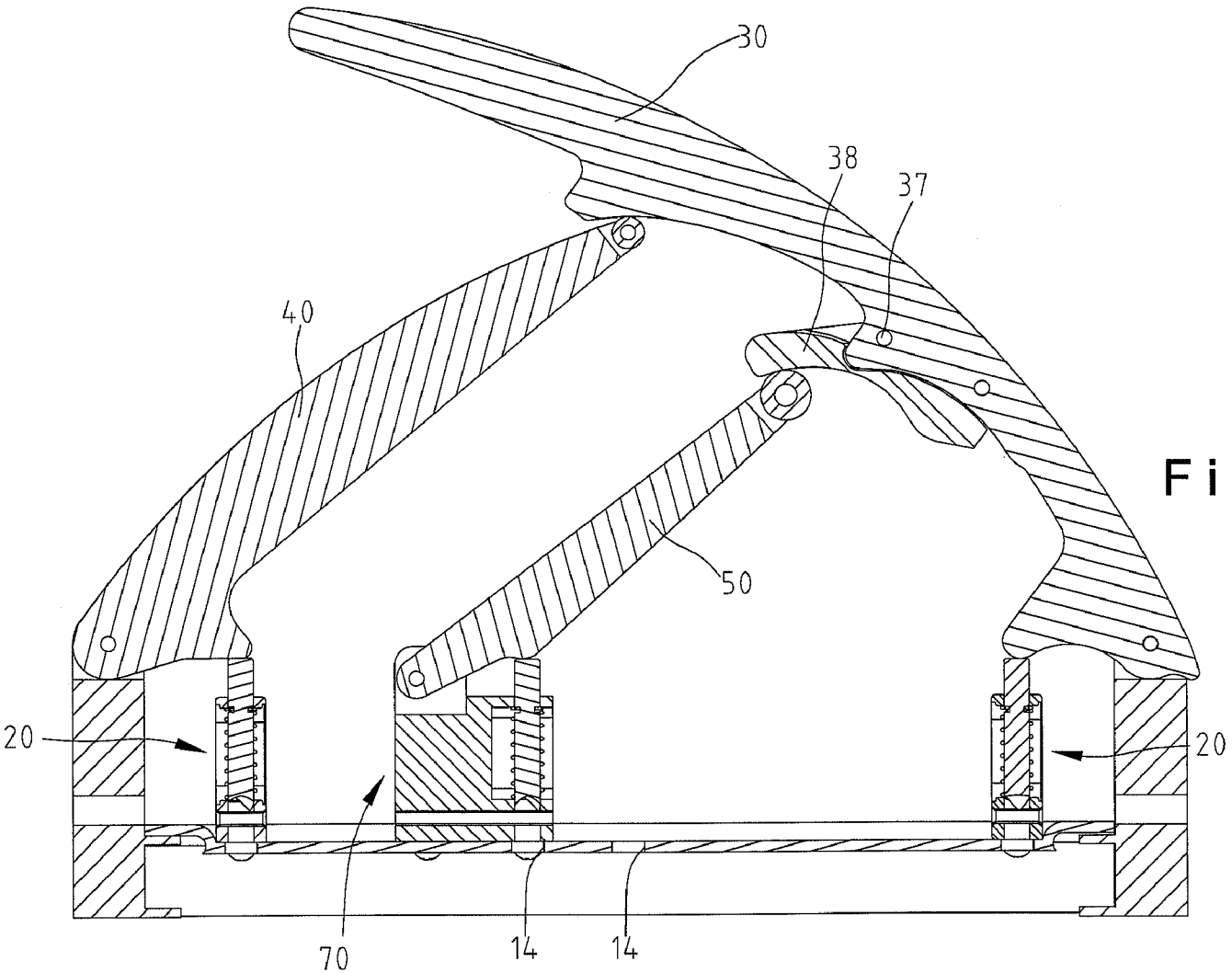
FIG. 7 is a cross-sectional view of the hole punching device of FIG. 6.
Figure 8:
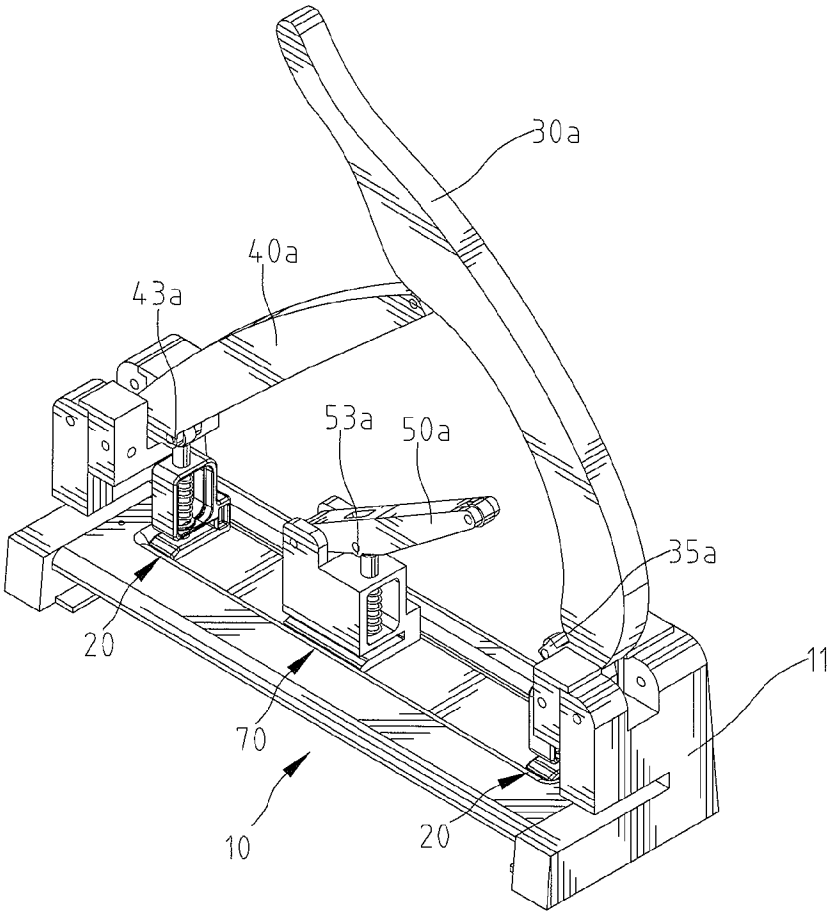
FIG. 8 is a perspective view of a hole punching device in accordance with a third embodiment of the present invention.
Figure 9:
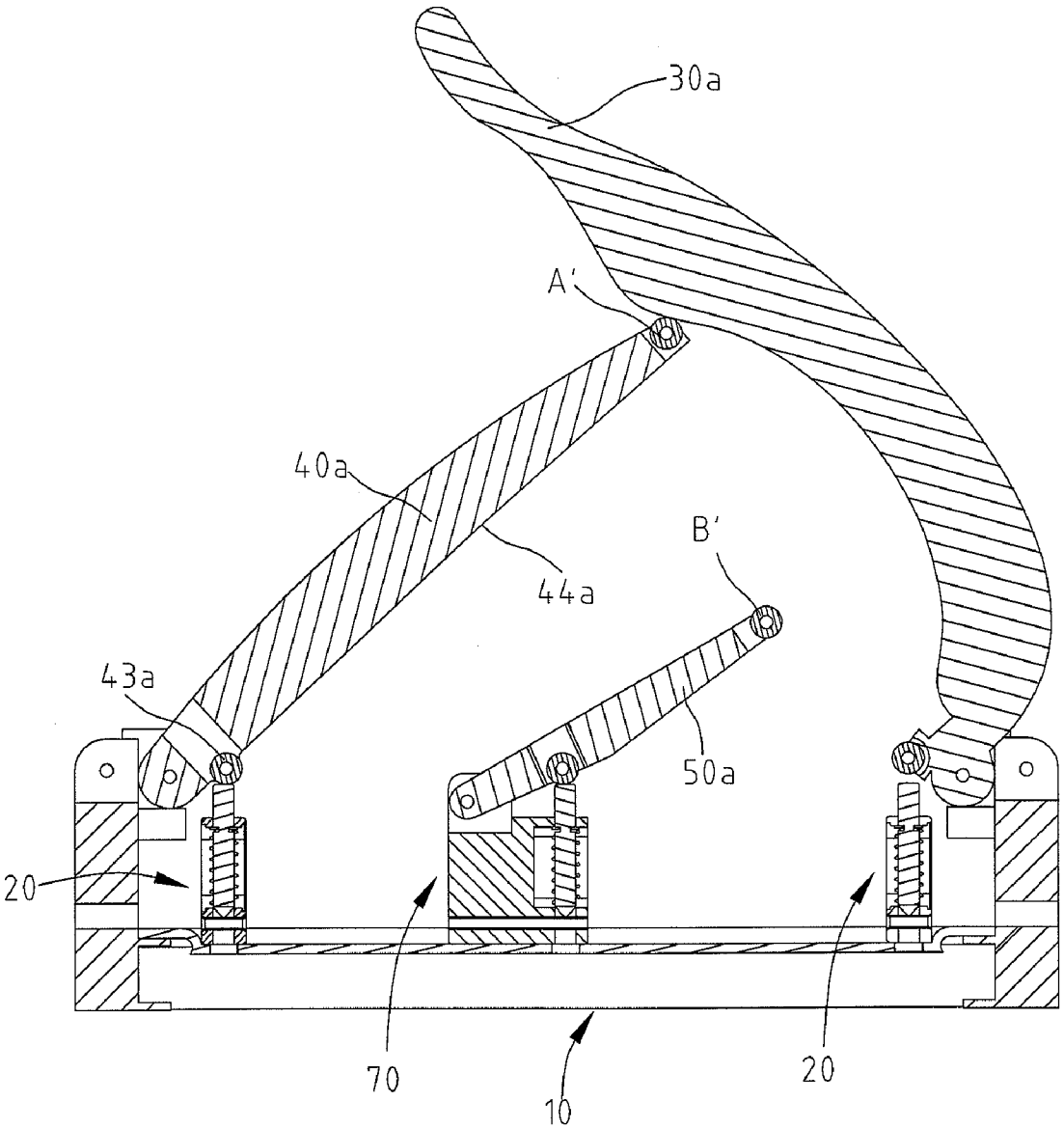
FIG. 9 is a cross-sectional view of the hole punching device of FIG. 8
Figure 10:
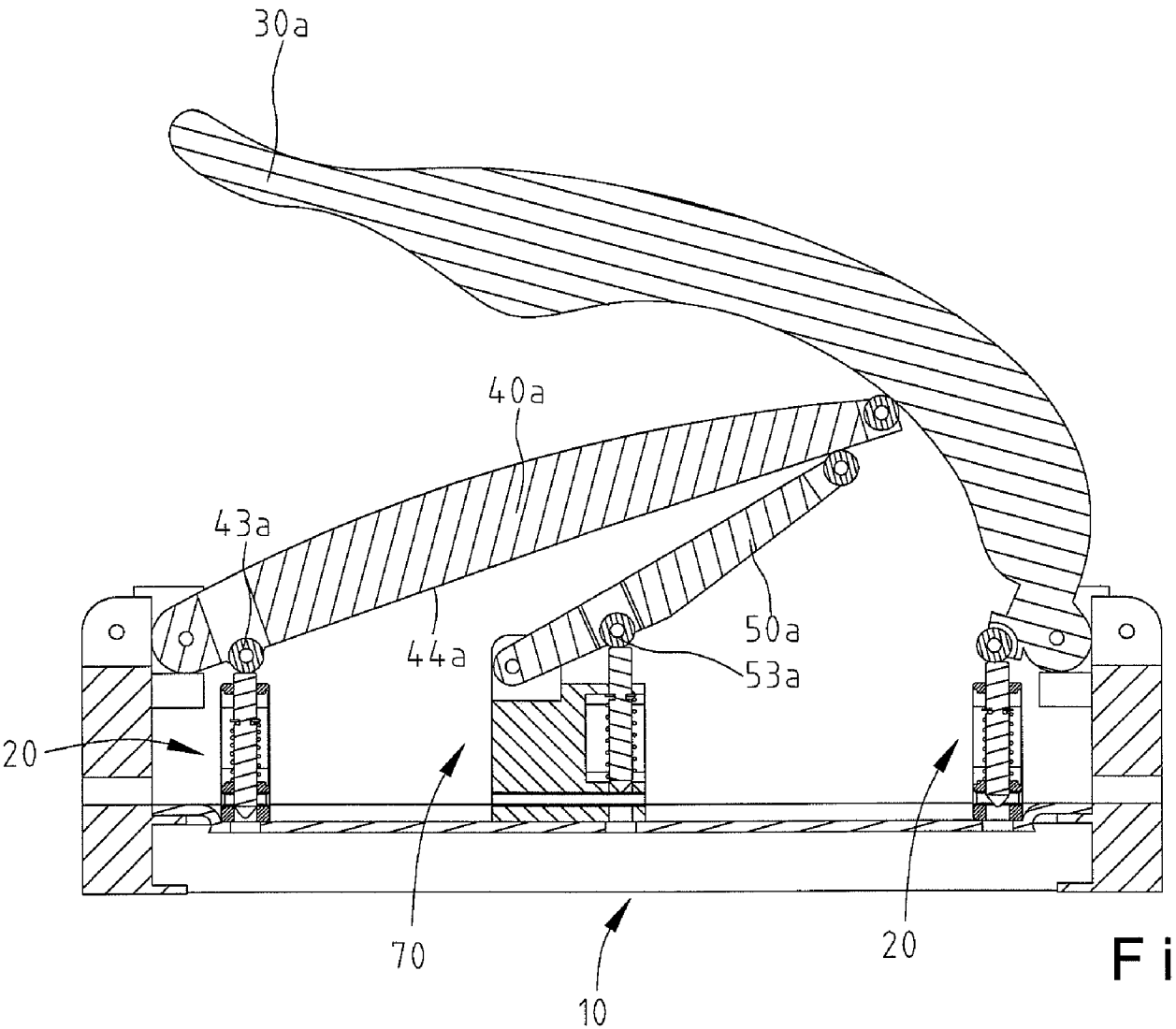
FIG. 10 is another cross-sectional view similar to FIG. 9, illustrating the hole punching device of FIG. 8 in another operational position.
Figure 11:
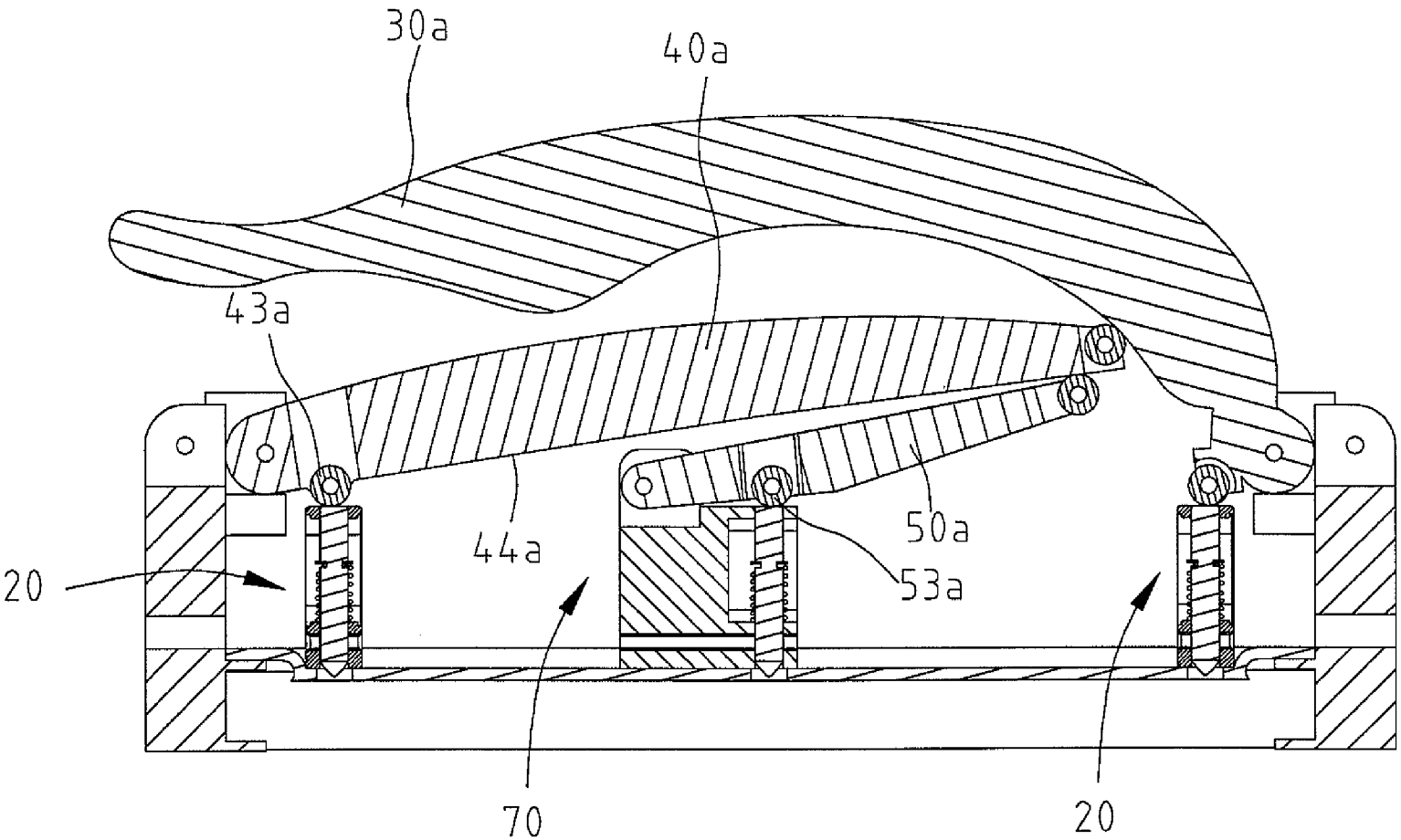
FIG. 11 is another cross-sectional view similar to FIG. 9, illustrating the hole punching device of FIG. 8 in another operational position.
Figure 12:
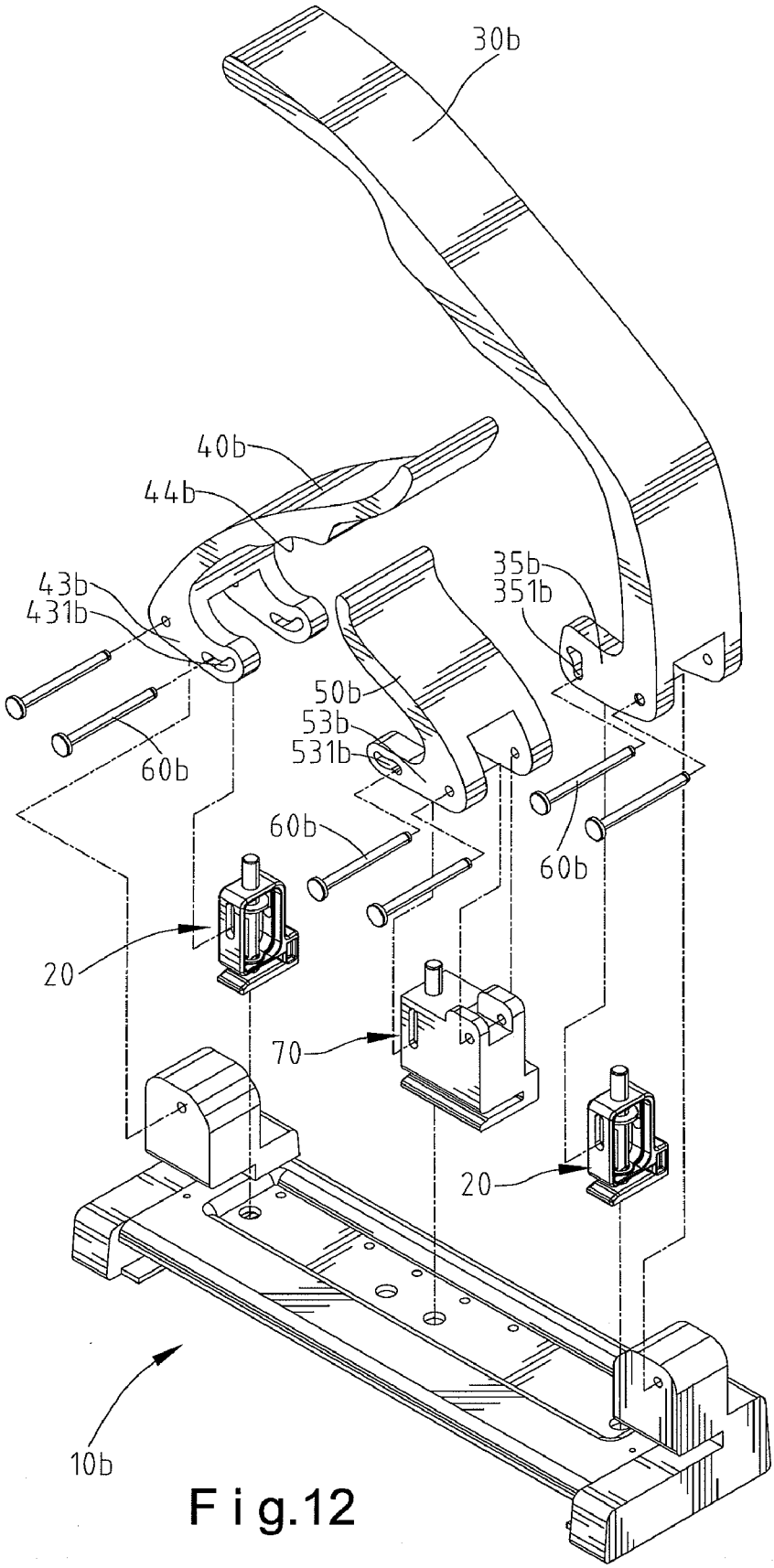
FIG. 12 is an exploded perspective view of a hole punching device in accordance with a fourth embodiment of the present invention.
Figure 13:
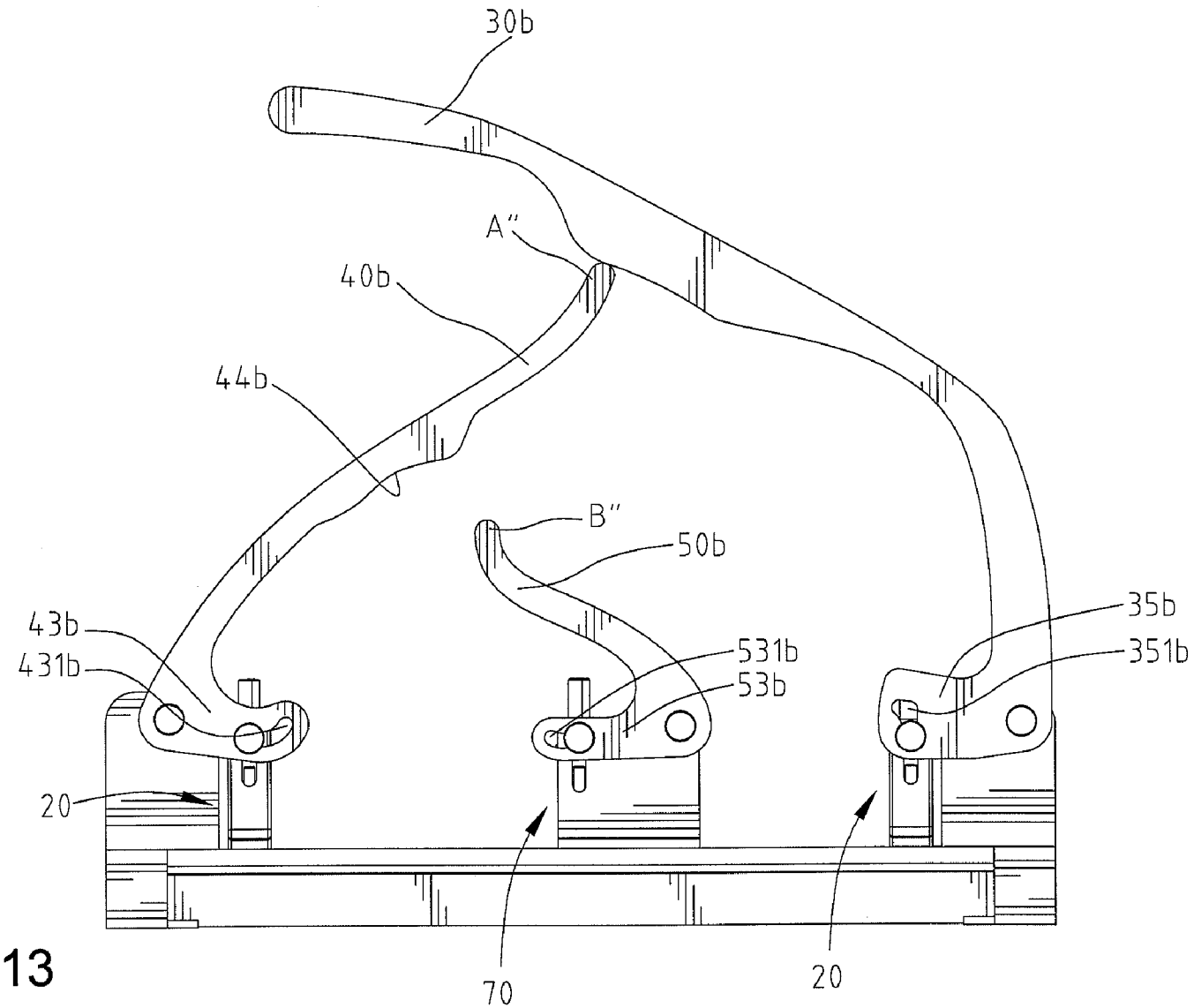
FIG. 13 is a side view of the hole punching device of FIG. 12.
Figure 14:
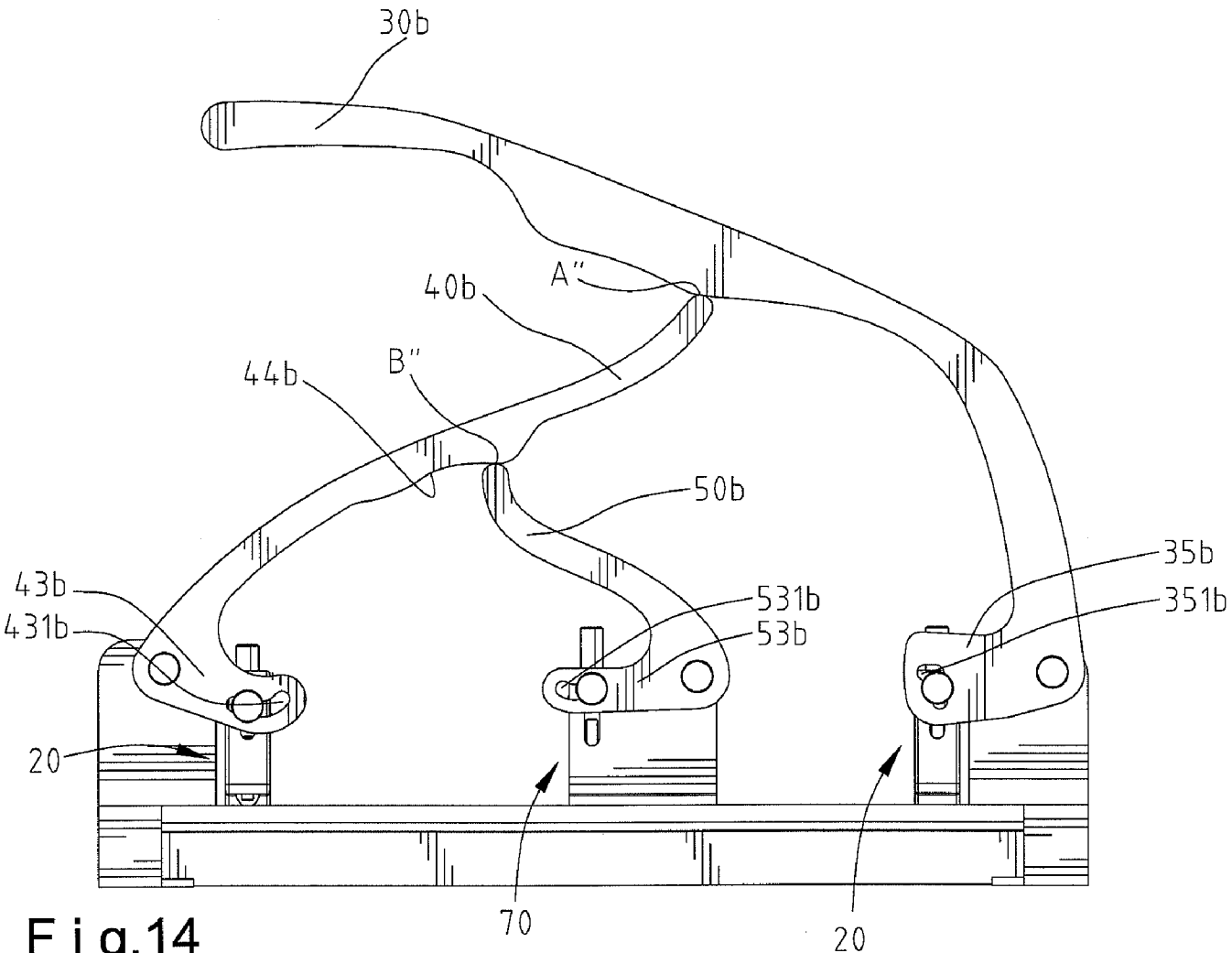
FIG. 14 is another side view similar to FIG. 13, illustrating the hole punching device of FIG. 12 in another operational position.
Figure 15:
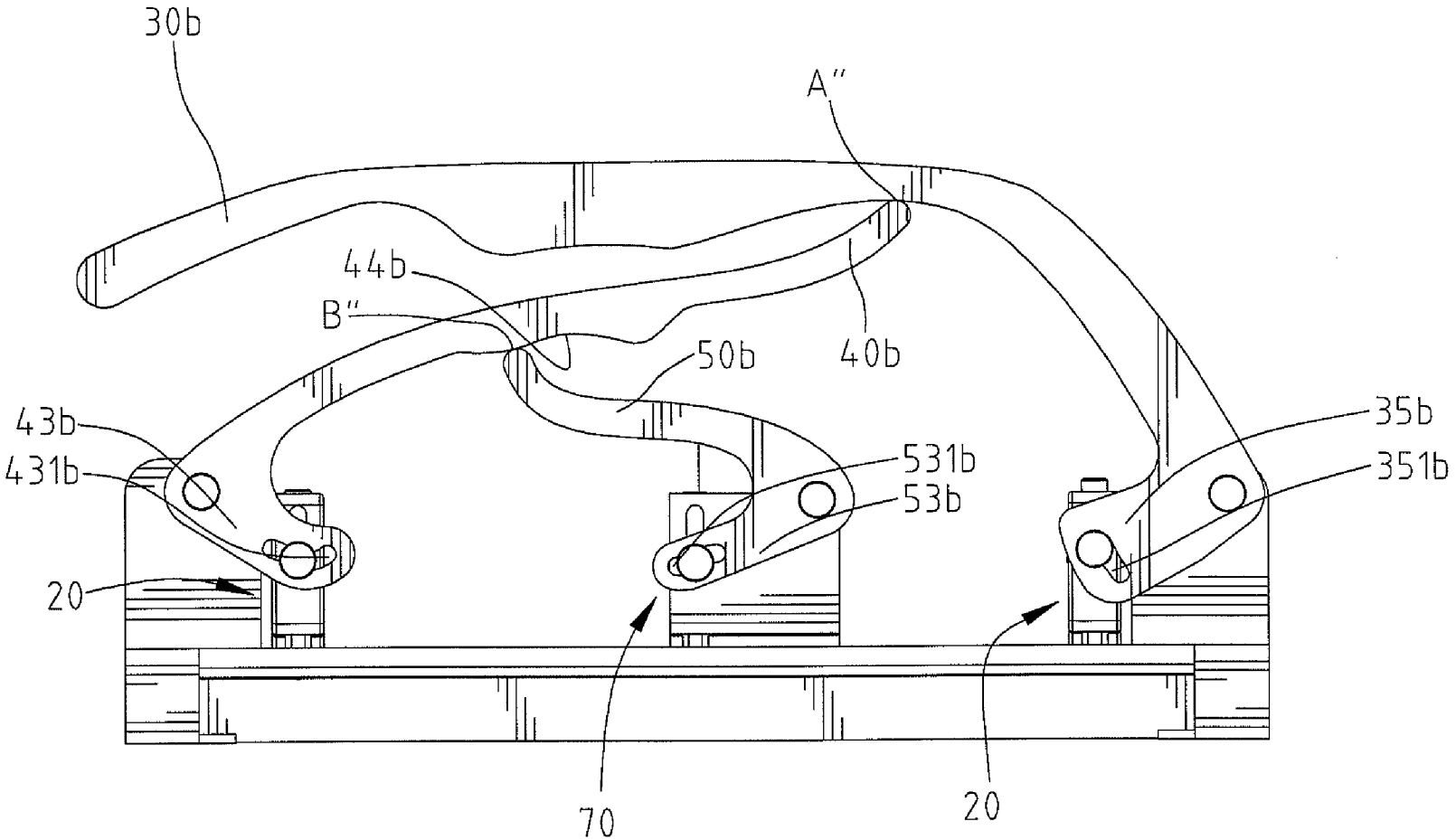
FIG. 15 is another side view similar to FIG. 13, illustrating the hole punching device of FIG. 12 in another operational position.

FIGS. 6 and 7 show a hole punching device in accordance with a second embodiment of the present invention. The hole punching device is similar to the first embodiment except that it includes a second guiding groove extension 38 installed to the first lever arm 30 by a pin 37, and the sliding portion B of the third arm 50 is adapted to be movably received in the second guiding groove extension 38. Note that in FIG. 7 the second punching member 70 is therefore adapted to be located at a further left position than a position in FIG. 5.

FIGS. 8 through 11 show a hole punching device in accordance with a third embodiment of the present invention. The hole punching device is similar to the first embodiment.

Accordingly, like numerals are employed to denote like components except bearing an "a". The hole punching device differentiates from the first embodiment in that it includes a first lever arm 30*a*, a second lever arm 40*a*, and a third lever arm 50*a*. The second lever arm 40*a* includes a sliding end A' moveable on the first lever arm 30*a*, and the third lever arm 50*a* includes a sliding portion B' spaced from the first lever arm 30*a*. The second lever arm 40*a* includes an edge 44*a* where the sliding portion B' of the third lever arm 50*a* is adapted to movably engage the edge 44*a* upon depression of the hole punching device. The first lever arm 30*a* includes an engaging portion 35*a*, the second lever arm 40*a* includes an engaging portion 43*a*, and the third lever arm 50*a* includes an engaging portion 53*a*. The engaging portions 43*a*, 53*a* are contemplated to include rolling members which are utilized to facilitate operation of the hole punching device.

Contrary to the first embodiment, the punch pins 23 of the associated first and second punching members 20, 70 in this embodiment are adapted to move into the corresponding punch holes 14 sequentially so as to further make depression of the hole punching device effort-saving.

FIGS. 12 through 15 show a hole punching device in accordance with a fourth embodiment of the present invention. The hole punching device is similar to the first embodiment. Accordingly, like numerals are employed to denote like components except bearing a "b". The fourth embodiment differentiates from the first embodiment in that it includes a first lever arm 30*b*, a second lever arm 40*b*, and a third lever arm 50*b*. The third lever arm 50*b* has a pivotal direction opposite to that of the second lever arm 40*b*. The second lever arm 40*b* includes a sliding end A" moveable on the first lever arm 30*b*, and the third lever arm 50*b* includes a sliding portion B" spaced from the first lever arm 30*a*. The second lever arm 40*b* includes an edge 44*b* where the sliding portion B" of the third lever arm 50*b* is adapted to movably engage the edge 44*b* upon depression of the hole punching device. The first lever arm 30*b* includes an engaging portion 35*b*, the second lever arm 40*b* includes an engaging portion 43*b*, and the third lever arm 50*b* includes an engaging portion 53*b*. The engaging portions 35*b*, 43*b*, 53*b* include slots 351*b*, 431*b*, and 531*b* respectively. Each of the slots 351*b*, 431*b*, 531*b* includes a positioning pin 60*b* inserting therethrough and is moveable at various positions in the associated slot 351*b*, 431*b*, 531*b* upon depression of the hole punching device.

Contrary to the first embodiment, the punch pins 23 of the associated first and second punching members 20, 70 in this embodiment are adapted to move into the corresponding punch holes 14 sequentially so as to further make depression of the hole punching device effort-saving. Also, the first lever arm 30*b* has a pivotal direction opposite to that of the second lever arm 40*b*, and the third lever arm 50*b* has a pivotal direction opposite to that of the second lever arm 40*b*.

Further, it is contemplated that the second and third lever arms 40*b*, 50*b* have sides substantially L-shaped, the second lever arm 40*b* has two engaging portions 43*b*, and the third lever arm 50*b* has two engaging portions 53*b*. A base 10*b* is therefore modified accordingly for connection with the second and third lever arms 40*b*, 50*b*.

While the specific embodiments have been illustrated and described, numerous modifications come to mind without significantly departing from the spirit of invention, and the scope of invention is only limited by the scope of the accompanying claims.

What is claimed is:

1. A hole punching device comprising:

a base including a plurality of punch holes;

two first punching members and a second punching member, with each of the first and second punching members including a punch pin, with the second punching member including a frame removably secured to the base, with the punch pin of the second punching member slideably mounted in the frame;

a first lever arm pivotally moving with respect to a proximal end of the base and abutting with and moving the punch pin of one of the two first punching members into one of the plurality of punch holes upon depression of the first lever arm;

a second lever arm pivotally moving with respect to a distal end of the base and abutting with and moving the punch pin of another of the two first punching members into another of the plurality of punch holes upon depression of the second lever arm; and a third lever arm pivotally mounted to the frame and moving with respect to the punch pin of the second punching member and abutting with and moving the punch pin of the second punching member into another of the plurality of punch holes upon depression of the third lever arm, with the frame and the third lever arm being movable and locatable at different positions intermediate the two first punching members;

wherein the first lever arm has a longitudinal length longer than those of the second and third lever arms, with the second lever arm being longer than that of the third lever arm; and wherein the first lever arm actuates the second and third lever arms upon depression of the first lever arm.

2. The hole punching device as claimed in claim 1 wherein the first lever arm has a pivotal direction opposite to a pivotal direction of the second lever arm.

3. The hole punching device as claimed in claim 2 wherein the first lever arm comprises a pivotal end and an operational end at a proximal end and a distal end thereof respectively, with the operational end allowing a user to operably depress the first lever arm, and wherein the second lever arm comprises a sliding end moveable on and between the pivotal end and the operational end of the first lever arm upon depression of the first lever arm.

4. The hole punching device as claimed in claim 3 wherein the third lever arm has a pivotal direction in accordance with a pivotal direction of the second lever arm.

5. The hole punching device as claimed in claim 3 wherein the third lever arm has a pivotal direction opposite to a pivotal direction of the second lever arm.

6. The hole punching device as claimed in claim 4 wherein the third lever arm comprises a sliding portion moveable on and between the pivotal end and operational end of the first lever arm upon depression of the first lever arm.

7. The hole punching device as claimed in claim 6 wherein the first lever arm comprises a first guiding groove and a second guiding groove, wherein the sliding end of the second lever arm is moveably received in the first guiding groove, and wherein the sliding portion of the third lever arm is moveably received in the second guiding groove.

8. The hole punching device as claimed in claim 7 further comprising a second guiding groove extension installed to the first lever arm, and wherein the sliding portion of the third lever arm is adapted to be movably received in the second guiding groove extension.

9. The hole punching device as claimed in claim 5, wherein the third lever arm comprises a sliding portion, wherein the second lever arm comprises an edge, and wherein the sliding portion is adapted to movably engage the edge upon depression of the first lever arm.

10. The hole punching device as claimed in claim 4 wherein the third lever arm comprises a sliding portion, wherein the second lever arm comprises an edge, and wherein the sliding portion is adapted to movably engage the edge upon depression of the first lever arm.

11. The hole punching device as claimed in claim 10 wherein the punch pins of the associated first and second punching members move into the corresponding punch holes sequentially so as to further make depression of the first lever arm effort-saving.

12. The hole punching device as claimed in claim 11 wherein each of the first, second, and third lever arms comprises an engaging portion extending therefrom and abutting the punch pins of one of the two first punching members, of another of the two first punching members, and of the second punching member respectively.

13. The hole punching device as claimed in claim 6 wherein each of the second and third lever arms comprises a roller installed to the sliding end and the sliding portion thereof respectively so as to make relative movement between the second and third lever arms with respect to the first lever arm effort-saving.

14. The hole punching device as claimed in claim 1 wherein the punch pins of the associated first and second punching members move into the corresponding punch holes substantially at the same time.

15. The hole punching device as claimed in claim 1 wherein each of the first, second, and third lever arms comprises an engaging portion extending therefrom and abutting the punch pins of one of the two first punching members, of another of the two first punching members, and of the second punching member respectively.

16. The hole punching device as claimed in claim 1 wherein the first, second and third lever arms pivot coplanar.

* * * * *